United States Patent [19]

Ishihara et al.

[11] 4,427,843

[45] Jan. 24, 1984

[54] ROD INSULATOR WITH ELASTIC OVERCOATS AND CONDUCTING PATHS STRADDLING JOINT PORTIONS OF ADJACENT OVERCOATS

[75] Inventors: Takeshi Ishihara, Toyoake; Michio Ishiwari, Kasugai; Shigeo Ishino, Aichi, all of Japan

[73] Assignee: NGK Insulators Ltd., Nagoya, Japan

[21] Appl. No.: 322,754

[22] Filed: Nov. 19, 1981

[30] Foreign Application Priority Data

Nov. 20, 1980 [JP] Japan ..... 55-162705

[51] Int. Cl.[3] ..... H01B 17/46; H01B 17/12

[52] U.S. Cl. ..... 174/140 S; 174/179

[58] Field of Search ..... 174/140 R, 140 S, 141 R, 174/144, 150, 178, 179, 209

[56] References Cited

U.S. PATENT DOCUMENTS

| | | | |
|---|---|---|---|
| 3,898,372 | 8/1975 | Kalb | 174/179 |
| 4,212,696 | 7/1980 | Lusk et al. | 174/179 X |
| 4,296,276 | 10/1981 | Ishihara et al. | 174/179 |
| 4,331,833 | 5/1982 | Pargamin et al. | 174/179 |

FOREIGN PATENT DOCUMENTS

| | | | |
|---|---|---|---|
| 2905150 | 10/1979 | Fed. Rep. of Germany | 174/179 |

*Primary Examiner*—Laramie E. Askin

*Attorney, Agent, or Firm*—Parkhurst & Oliff

[57] ABSTRACT

A synthetic resin insulator comprising a fiber-reinforced plastic rod provided at its both ends with holding metal fittings; a plural number of overcoats fitting to and covering the plastic rod, each overcoat consisting of an elastic insulating material and provided at its outside with a shed; and a conducting path formed straddling the joint portion of adjacent overcoats flows leakage current through the conducting path, is not eroded at the joint portion of adjacent overcoats, and is very long in the life.

17 Claims, 23 Drawing Figures

ROD INSULATOR WITH ELASTIC OVERCOATS AND CONDUCTING PATHS STRADDLING JOINT PORTIONS OF ADJACENT OVERCOATS

BACKGROUND OF THE INVENTION (1) Field of the Invention

The present invention relates to an improvement of synthetic resin insulators comprising a fiber-reinforced plastic rod or pipe (hereinafter, referred to as reinforced plastic rod), overcoats consisting of an elastic insulating material, and holding metal fittings.

(2) Description of the Prior Art

A reinforced plastic rod, reinforced with bundles of fibers or knitted fiber bundles in their axial direction, has a resistance against very high tensile stress and an extremely high strength-to-weight ratio. While, elastic insulating materials, such as silicone rubber, ethylene-propylene rubber, polyethylene, polypropylene, ethylene-propylene copolymer, cycloalipatic epoxy, acrylic, polyfluoroethylene and the like, occasionally mixed with an inorganic filler having a low decomposition temperature, such as alumina trihydrate or the like, have excellent weather resistance and tracking resistance, recently there have been made various investigations for producing light and high-strength synthetic resin insulators by combining these elastic insulating materials. As a typical synthetic resin insulator, there has been known an insulator comprising a reinforced plastic rod 1, a large number of superposed overcoats 3 made of an elastic insulating material and fitted to the rod 1, each overcoat 3 being provided at its outside with one shed, and grease 6 filled in the interface 4 between the reinforced plastic rod 1 and the overcoats 3, as illustrated in FIG. 1, FIG. 2*a* and FIG. 2*b*.

However, the conventional synthetic resin insulator, wherein a large number of individual overcoats 3 are superposed, is assembled in the following manner in order to prevent the leakage of grease 6 from the interface 4 or the penetration of water or the like into the interface 4. That is, overcoats 3 having an inner diameter smaller than the outer diameter of a reinforced plastic rod 1 are used in order to fasten tight always the reinforced plastic rod 1 and further the overcoats 3 are compressed in their axial direction between both holding metal fittings 2 and 2 to cause pressure between adjacent overcoats 3 and 3. As a result, the overcoats 3 are always elongated to the circumferential direction. Such elongated state promotes the breakage of molecular chain of elastic insulating material due to oxygen, ultraviolet ray and the like, and the electric insulating material in elongated state is apt to be easily deteriorated. Particularly, the shoulder x at the contact portion 5 of adjacent overcoats 3 is easily deteriorated by oxidation due to its large specific surface area as shown in FIG. 2*a*. Moreover, as the overcoats 3 are compressed in their axial direction, stress is concentrated into the shoulder $x_1$ and the shoulder $x_1$ is elongated in a large amount and is apt to be deteriorated more easily. In general, this erosion proceeds in a direction perpendicular to the stretching direction. In addition, the shoulder $x_1$ is eroded by the minute discharges due to leakage current, which flows on the overcoat surface during rainfall, as shown by the mark $x_2$ in FIG. 2*b*, and the erosion grows rapidly in the form of a groove in a direction perpendicular to the stretching direction, that is, towards the interface 4 between the reinforced plastic rod 1 and the overcoats 3 in combination with the above-described deterioration of the shoulder. This directional erosion reaches the interface 4 between the overcoat 3 and the reinforced plastic rod 1 in a very short period of time to cause leakage of the grease 6 and penetration of water easily, and to promote insulation breakdown of the interface 4, and further to erode and break the reinforced plastic rod. As a result, the function of the insulator is lost. In this case, the deterioration speed of the function of the insulator due to erosion depends upon the erosion speed at the contact portion of adjacent overcoats 3.

Furthermore, when the insulator is practically used in the power transmission line, the insulator is exposed to the direct ray of the sun to cause temperature rise of the insulator, and grease 6 filled in the interface 4 is expanded due to the temperature rise to expand the overcoat 3. In this case, since airtightness between adjacent overcoats superposed one upon another is secured merely by the action of compression force in the axial direction of the overcoats, the expanded grease 6 leaks from the contact portion 5 of adjacent overcoats 3. Moreover, when a hot-line washing is carried out by the use of high-pressure water in order to wash away pollutant adhered to insulators used in a substation or the like in a region wherein insulators are violently polluted, the overcoats 3 are forcedly moved by the high-pressure water blown thereto to form gaps at the contact portion 5 of adjacent overcoats 3 and 3, and water is penetrated into the interface 4 through the gaps. As described above, there are many problems. In order to overcome these problems, there has been proposed an insulator, wherein a reinforced plastic rod 1 is bonded with overcoats 3 at the interface 4 with an adhesive and adjacent overcoats 3 are bonded with each other at the contact portion 5 with an adhesive. However, in this insulator, since the adhesive is generally an active material, the adhesive, even after solidified, is apt to be deteriorated more easily than the overcoat materials, and when the adhesive is exposed to the external atmosphere at the contrast portion 5 of adjacent overcoats, the adhesive layer is firstly deteriorated by the action of the above-described ultraviolet ray and oxygen and water in the external atmosphere, followed by the erosion due to minute discharges, to form gaps in the adhesive layer; and the shoulder $x_1$ which has a large specific surface area and is liable to be oxidized and deteriorated, is successively eroded and deteriorated. This erosion reaches the interface 4 in a short period of time similarly to the above-described insulator, wherein grease 6 is filled in the interface 4, to cause insulation breakdown at the interface 4 and further to erode gradually the reinforced plastic rod 1, resulting in the separation of the insulator. Therefore, the insulator has serious drawbacks.

Further, there has been known an insulator produced by molding directly an individual overcoat 3 having one shed 8 on a reinforced plastic rod 1 by means of a mold 12 and repeating this molding to form the whole overcoats into substantially a unitary structure as illustrated in FIGS. 3*a* and 3*b*. However, in this insulator, the bonded plane 13 of adjacent overcoats 3 and 3 formed in every molding is weak chemically and mechanically and is apt to be oxidized and deteriorated, and moreover when the reinforced plastic rod 1 is elongated by the load applied to the insulator, the bond plane 13 of the overcoats 3 is often exfoliated, and therefore the insulator has serious drawbacks similarly to the above-described insulator. In order to solve the above-described drawbacks and problems, there has been proposed an insulator having a seamless unitary overcoat. However, a large size mold is required for producing the overcoat 3 corresponding to the increase of the length of insulator, and moreover it is very difficult to mold a long, slender, shed-shaped, peculiar overcoat, and mass production of the overcoat 3 having a length of more than 1 m is considered to be difficult.

Recently, the transmission voltage is raised more and more in order to obtain a high transmission efficiency, and an insulator having a long insulating distance has become necessary corresponding to the high transmission voltage.

Accordingly, when it is intended to obtain a desired insulating distance by using relatively short seamless unitary insulators, a large number of the insulators must be connected. There are many problems, namely, the insulating distance must be long in an amount corresponding to the lengths of respective holding metal fittings. Therefore, a tall steel tower which is required is expensive. Moreover, the weight of the insulator assembly increases corresponding to the increase of the number of holding portions, and further the respective holding metal fitting portions form weak points due to concentration of mechanical stress and electric stress, and hence the reliability of the insulator is lost when a large number of the weak points are formed.

SUMMARY OF THE INVENTION

The object of the present invention is to obviate the above-described drawbacks and problems in the conventional synthetic resin insulators.

That is, the feature of the present invention is the provision of a synthetic resin insulator, comprising a fiber-reinforced plastic rod, holding metal fittings which hold both ends of the fiber-reinforced plastic rod, a plural number of overcoats which consist of an elastic insulating material and cover the total surface of the fiber-reinforced plastic rod located between the holding metal fittings, and conducting paths formed straddling the joint portion of adjacent overcoats in order that leakage current, which flows on the surface of the insulator when the insulator is wetted, flows through the conducting path and does not flow through the joint portion of the overcoats.

DESCRIPTION OF THE PREFERRED EMBODIMENT

The present invention will be explained in more detail by the following examples referring to FIGS. 4*a*–19. Among the references in these figures, the same references as those shown in FIGS. 1–3*b* represent the same portion as or corresponding portion to those shown in FIGS. 1–3*b*.

Figure 4A:
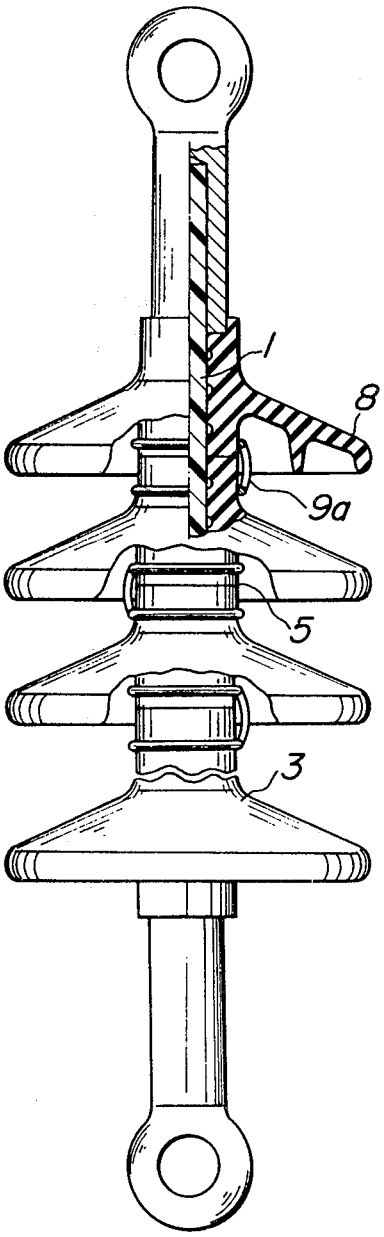
FIG. 4*a* is a front view of a synthetic resin insulator of the present invention, partly in section.

The synthetic resin insulator of the present invention, as illustrated in FIG. 4*a*, comprises a reinforced plastic rod 1 produced by impregnating bundles of fibers, such as glass and the like, arranged in their axial direction or knitted fiber bundles with a synthetic resin, such as epoxy resin, polyester resin or the like, and curing the resin; holding metal fittings 2 and 2, which are fixed at one end to both ends of the reinforced plastic rod 1, and are provided at their another end with a structure, for example, an eye-ring, clevis or mounting base for line-post insulator, fitting member, for fitting directly or indirectly the holding metal fitting to conductor or steel tower arm or other supporters; a plural number of overcoats 3 consisting of a rubber-like elastic insulating material, such as silicone rubber, ethylene-propylene rubber or the like, and covering substantially the total surface of the reinforced plastic rod 1 located between the holding metal fittings 2 and 2, each overcoat 3 being provided at its outside with a shed 8 unitarily formed; and conducting paths 9*a*, each made of a conductive material, such as metal or the like, and having a proper shape, and being formed straddling the joint portion 5 of adjacent overcoats 3 and 3 so that leakage current, which flows on the surface of the insulator when the insulator is wet, is locally short-circuited not to flow through the joint portion 5 of the overcoats.

Figure 4B:
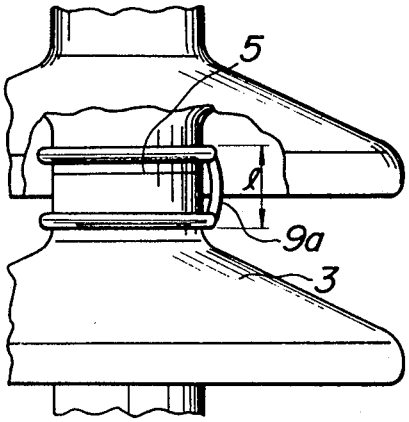
FIGS. 4*b* and 4*c* are enlarged front views of essential parts, partly broken, of synthetic resin insulators of the present invention.
Figure 4C:
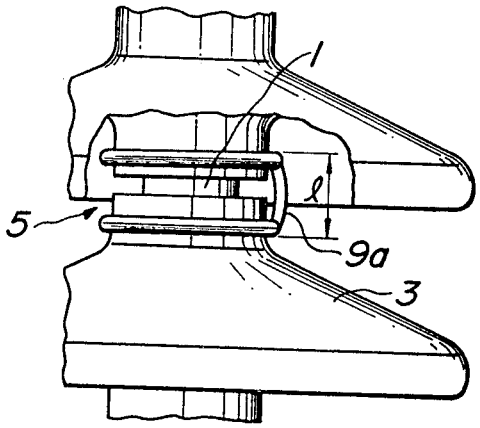

The conducting path 9a has a long length l enough to straddle the joint portion 5 of adjacent overcoats, which are contacted to each other or apart from each other at the ends, as illustrated in FIGS. 4b and 4c in an enlarged scale.

Figure 5:
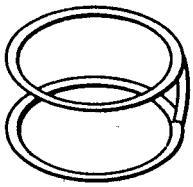
FIGS. 5, 6 and 7 are explanative views of embodiments of conducting paths used in the synthetic resin insulator of the present invention.
Figure 6:
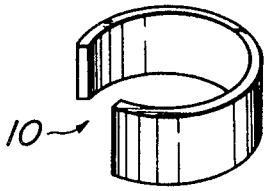
Figure 7:
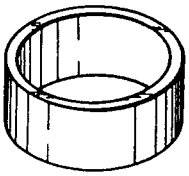
Figure 8:
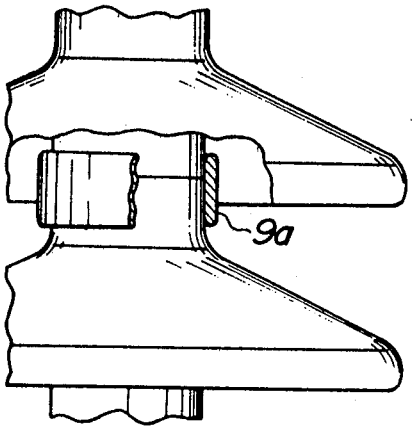
FIGS. 8, 9 and 10 are explanative views of other embodiments of conducting paths used in the synthetic resin insulator of the present invention.
Figure 9:
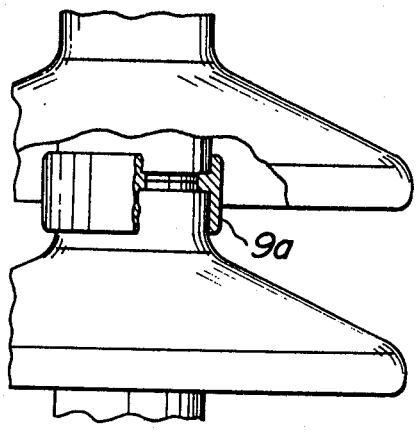
Figure 10:
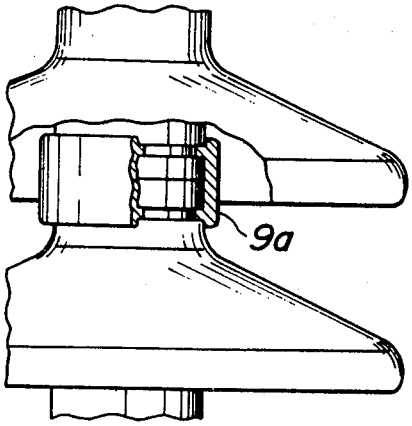

In the present invention, a conducting path 9a having a shape illustrated, for example, in FIGS. 5, 6 or 7 can be optionally used. The conducting path 9a illustrated in FIG. 5 is made of two metal rings arranged concentrically and connected with each other into a unitary structure through a rod-shaped conducting member; that illustrated in FIG. 6 is made of a metal plate having a given width and curved along the surface of an insulator in the peripheral direction; and that illustrated in FIG. 7 is made of a metal or other conductive material formed into a hollow cylinder. Further, the cross-sectional shape of the conducting path 9a along the center axis is formed into the following shape. For example, in a hollow cylindrical conducting path, a smooth inner side surface as illustrated in FIG. 8 can attain the object of the present invention. Further, a conducting path having a projection at the center portion of inside so that the projection can be fitted into the recess formed at the edge of the joint portion 5 of adjacent overcoats as illustrated in FIG. 9; or a conducting path, wherein recesses are formed on each of adjacent overcoats 3 and 3 at a position apart from the joint portion 5 and projections are formed on the upper and lower sides of the inner side surface of the conducting path so that the projections can be fitted into the recesses as illustrated in FIG. 10; are preferably used. The arrangements of conducting path as illustrated in FIGS. 9 and 10 are free from the shifting of the positions to the overcoats and the conducting path in the fitted state, and are preferable.

The insulator having a conducting path 9a arranged on the joint portion 5 of adjacent overcoats according to the present invention has the following merits contrary to the conventional insulator. In the conventional insulator, when the overcoat surface is wetted during rainfall, leakage current flows on the surface of the overcoat to generate minute discharges by leakage current on the overcoat surface, and the overcoat is eroded by the minute discharges to lose the function of insulator. However, in the insulator of the present invention, the leakage current flows selectively through the conducting path 9a arranged on the joint portion 5, and minute discharges do not generate in the joint portion 5. Therefore, the insulator of the present invention has a remarkably prolonged life.

The above-described effect will be explained based on the test results shown in the following Tables 1 and 2. Samples A, B and C shown in Table 1 are conventional insulators having no conducting path 9a. Sample A contains grease filled in the interface 4 in the structure shown in FIG. 1; Sample B has bonded overcoats 3 with adhesive at the joint portion 5 in the structure shown in FIG. 1; and Sample C has overcoats 3 formed by repeated moldings shown in FIGS. 3a and 3b. Samples D, E and F shown in Table 1 are insulators of the present invention. Sample D has a conducting path 9a arranged on the joint portion 5 of Sample A; Sample E has a conducting path 9a arranged on the joint portion 5 of Sample B; and Sample F has a conducting path 9a arranged on the joint portion of Sample C. All the Samples A to F have overcoats made of ethylene-propylene rubber.

Samples G and H shown in Table 2 are conventional insulators having no conducting path 9a. Sample G has overcoats 3 made of polyethylene and contains grease 6 filled in the interface 4 in the structure shown in FIG. 1, and Sample H has overcoats 3 made of cycloaliphatic epoxy and formed by repeated moldings shown in FIGS. 3a and 3b. Samples I and J shown in Table 2 are insulators of the present invention. Samples I and J have a conducting path 9a arranged on the contact portion 5 of samples G and H, respectively.

As the conducting path 9a, there was used a conducting path having a length l of 30 mm, which consisted of two copper wire rings connected unitarily with each other through a conducting member, such as copper wire or the like. Each sample insulator had a dimension of an outer diameter of the shell portion of 36 mm, a diameter of the shed of 138 mm, a distance in a straight line between both holding metal fittings of 200 mm, the number of sheds of 3, and a shed pitch of 60 mm. A brine was sprayed intermittently on the insulator under a condition that a voltage of 20 KV was applied. Spray procedure was repetition of 10 seconds spraying at a flow rate of 120 ml/min and 20 seconds intermission. This cycle was repeated continuously to flow forcedly leakage current on the overcoat surface, to cause minute discharges on the overcoat surface, and to erode the overcoat. The portion, at which the erosion developed, and the time until the erosion reached the interface were measured. The obtained results are shown in Tables 1 and 2.

TABLE 1

| | | Eroded portion | Time until erosion reached interface (days) |
|---|---|---|---|
| Conventional insulator | Sample A | contact portion | 20 |
| | Sample B | contact portion | 28 |
| | Sample C | contact portion | 30 |
| Insulator of this invention | Sample D | upper portion of conducting path | not less than 200 |
| | Sample E | upper portion of conducting path | not less than 200 |
| | Sample F | upper portion of conducting path | not less than 200 |

TABLE 2

| | | Eroded portion | Time until erosion reached interface (days) |
|---|---|---|---|
| Conventional insulator | Sample G | contact portion | 25 |
| | Sample H | contact portion | 20 |
| Insulator of this invention | Sample I | upper portion of conducting path | not less than 200 |
| | Sample J | upper portion of conducting path | not less than 200 |

It can be seen from the test results shown in Tables 1 and 2 that, in the conventional insulators of Samples A, B, C, G and H, erosion develops at the contact portion of overcoats, and the erosion reached the interface between the reinforced plastic rod and the overcoat in 20–30 days; while, in the insulators of the present invention of Samples D, E, F, I and J, the joint portion is not at all eroded, and erosion develops at a portion other than the joint portion, and not less than 200 days are required until the erosion reaches the interface, which illustrates that the insulator of the present invention is expected a life as long as not less than 10 times the life of the conventional insulator.

In the above-described insulators, the conducting path formed straddling the contact portion of overcoats is made of two metal rings connected concentrically to each other through a conducting member. Also, the conducting path may be made of a metal plate having a given width and curved along the insulator surface in the peripheral direction as illustrated in FIG. 6. This conducting path can be easily mounted on the joint portion 5 of overcoats, prevents generation of minute discharges at the joint portion 5 of overcoats, and further interrupts the ultraviolet ray, whereby the conductive path prevents the deterioration of the insulator due to these phenomena. Therefore, the conducting path is preferably used. Furthermore, a hollow cylindrical conducting path illustrated in FIG. 7 is particularly preferably used, because the conducting path can cover completely the joint portion 5, and therefore the conducting path can prevent surely generation of minute discharges, interrupt the ultraviolet ray and further prevent the penetration of water and the like into the interface 4 between an overcoat 3 and a reinforced plastic rod 1.

Figure 12:
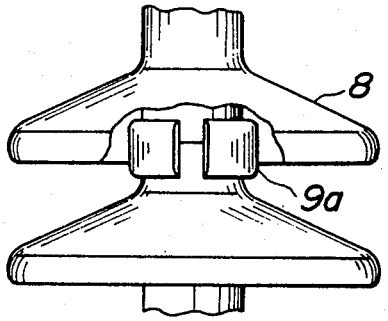
FIG. 12 is an explanative view of one embodiment of a conducting path used in the synthetic resin insulator of the present invention.

In the curved conducting path 9*a* illustrated in FIG. 6, when the conducting path is mounted on along the surface of an insulator in the peripheral direction, an opening 10 is formed along the center axis in the peripheral direction. In this case, when the opening 10 has a width in the peripheral direction of not larger than $\frac{1}{4}$ of the total peripheral length of the conducting path 9*a* as illustrated in FIG. 12, the joint portion 5 of overcoats 3 can be substantially protected from the erosion due to leakage current.

Figure 11:
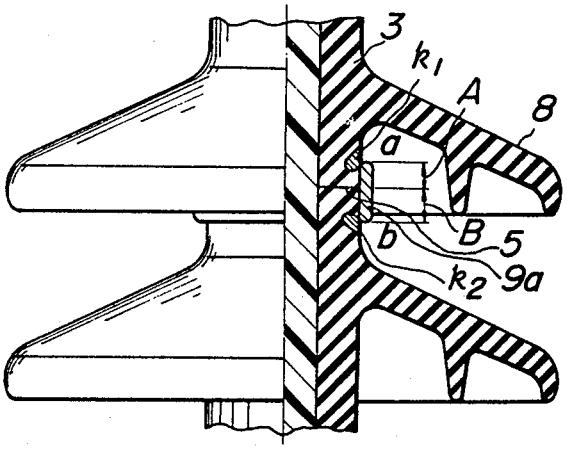
FIG. 11 is a view for explaining the eroded state in the synthetic resin insulator of the present invention.

Further, erosions $k_1$ and $k_2$ are formed due to leakage current at the both ends of the conducting path 9*a*. For example, the case of the hollow cylindrical conducting path is illustrated in FIG. 11. The upper end a is located at the back side of the shed 8 of the upper overcoat 3, one of the adjacent overcoats 3 and 3. The lower end b is located at the front side of the shed 8 of the lower overcoat 3, the other of the adjacent overcoats 3 and 3. The overcoat 3, which contacts with the lower end b of the conducting path 9*a*, is apt to be eroded more easily than that which contacts with the upper end a of the conducting path 9*a*. Therefore, when the length of the upper portion and that of the lower portion of the conducting path 9*a* measured from the joint portion 5 of the adjacent overcoats 3 and 3 are represented by references A and B respectively, the following conditions $$A \geqq 5 \text{ mm and } A \leqq B$$

are preferred to be satisfied in order to prevent the growth of the erosion up to the interface 5 due to the leakage current which flows on the overcoat 3 in a small amount not to cause deterioration of the function of the insulator.

Figure 13:
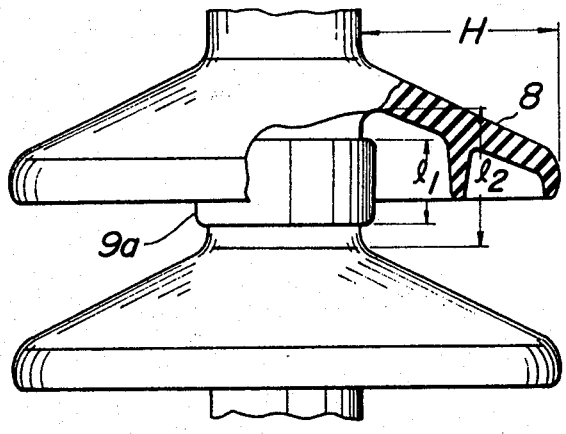
FIG. 13 is a view for explaining a relation between the overhung length of a shed of an overcoat and the distance between adjacent sheds.

Further, it is preferable that the overhung length H of a shed 8 formed on a overcoat 3 is not less than $\frac{1}{2}$ of the length $l_1$ of a conducting path 9*a* and the distance $l_2$ between adjacent sheds is not more than 2 times the overhung length H of a shed as shown in FIG. 13, because the decreasing of an effective length of the insulator due to the arrangement of the conducting path 9*a* can be compensated by the above-described limitation of $l_1$, $l_2$ and H.

Figure 14:
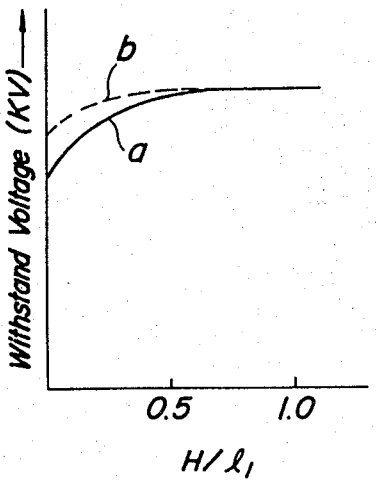
FIG. 14 is a graph illustrating a relation between the ratio of the overhung length of a shed to the length of conducting path and the withstand voltage in a insulator.
Figure 15:
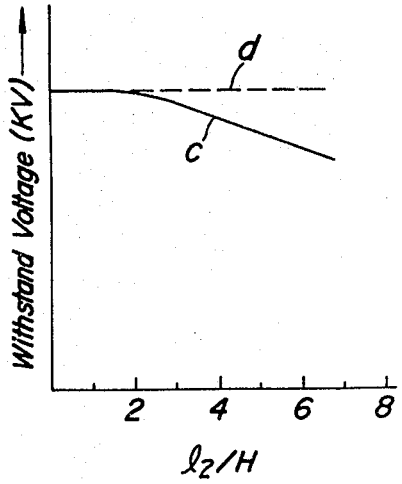
FIG. 15 is a graph illustrating a relation between the ratio of the distance between adjacent sheds to the overhung length of a shed and the withstand voltage in an insulator.
Figure 16:
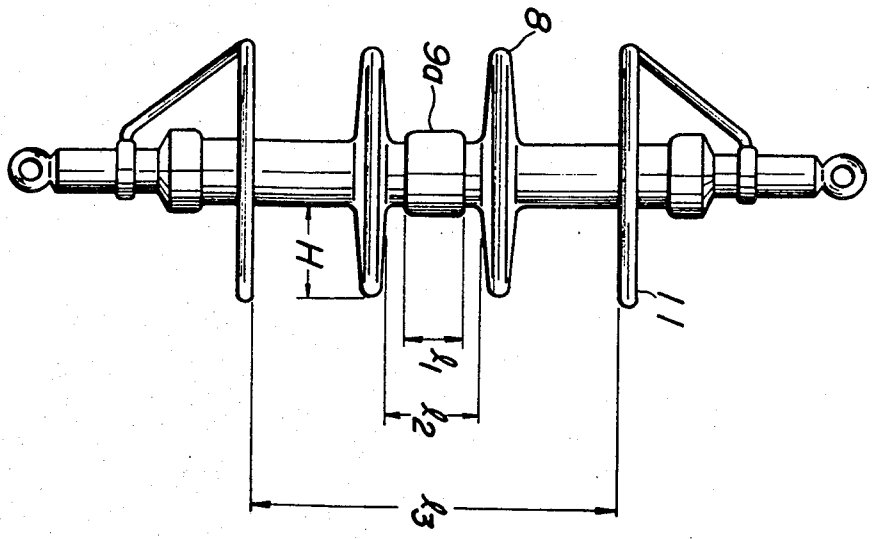
FIG. 16 is a front view of an insulator used for the measurement of the properties illustrated in FIGS. 14 and 15.

The above-described facts will be explained referring to FIGS. 14, 15 and 16. FIGS. 14 and 15 illustrate withstand voltage properties of insulators with and not with the conducting path 9*a*. FIG. 16 illustrates the sample insulator being made on experiment. The distance $l_3$ between the electrodes of the sample insulators is 1,000 mm and the length $l_1$ of a hollow cylindrical conducting path 9*a* in the axial direction is 30 mm. In the above experiment, in order to make the effective length uniform, an arcing horn 11 is arranged, which has an overhung length 10 mm larger than the overhung length H of the shed.

FIG. 14 illustrates a relation between the ratio of $H/l_1$ shown in abscissa and the withstand voltage shown in ordinate in the case where $l_1$ is substantially equal to $l_2$ and H is varied. The solid line (a) in FIG. 14 illustrates the relation when the conducting path 9*a* is used, and the dotted line (b) illustrates the relation when the conducting path 9*a* is not used. It can be seen from FIG. 14 that, when the overhung length H of a shed is not less than $\frac{1}{2}l_1$, the decrease of withstand voltage of an insulator due to the use of a conducting path 9*a* does not appear. Further, FIG. 15 shows a relation between the ratio of $l_2/H$ shown in abscissa and the withstand voltage shown in ordinate. In FIG. 15, the solid line (c) illustrates the relation when the conducting path 9*a* is used, and the dotted line (d) illustrates the relation when the conducting path 9*a* is not used. It can be seen from FIG. 15 that, when the ratio of $l_2/H$ is less than 2, wherein $l_2$ represents the distance between adjacents sheds and H represents the overhung length of a shed, the decrease of withstand voltage property due to the use of the conducting path 9*a* does not appear.

Figure 17:
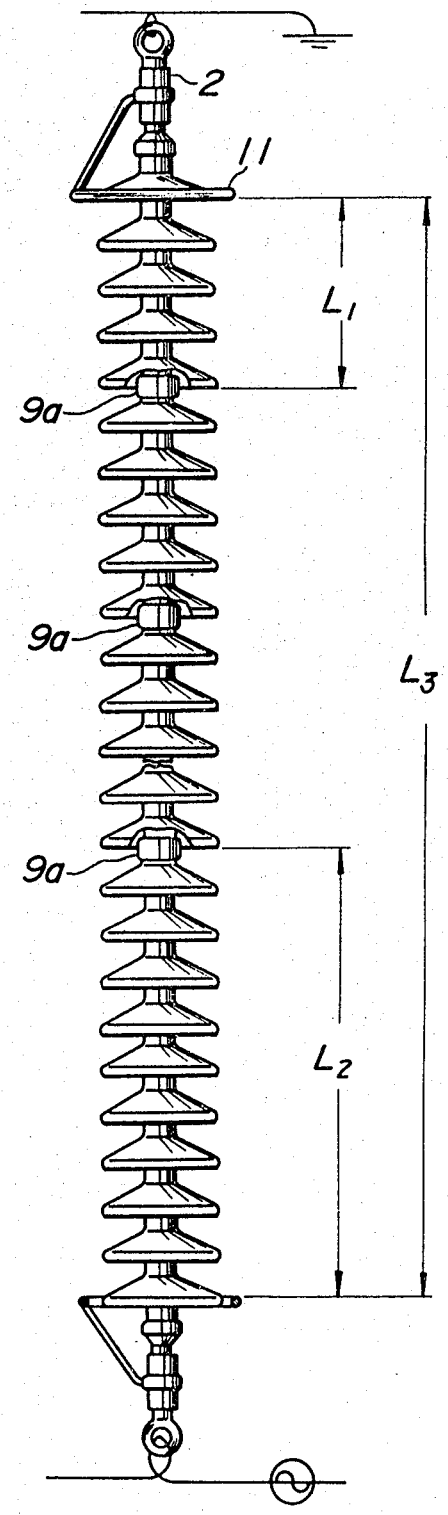
FIG. 17 is a view for explaining an insulator used in the measurement of a relation between the ratio of $L_2/L_3$, wherein $L_2$ represents the distance between the electrode of the energized end side and the conducting path adjacent to the electrode, and $L_3$ represents the effective length in a synthetic resin insulator of the present invention, and the withstand voltage of the insulator.

Further, as to the distances $L_1$ and $L_2$ between the holding metal fittings 2 or electrode-forming portions, which are fitted to the holding metal fittings 2 and have an arcing horn, (hereinafter, the holding metal fitting or the electrode-forming portion is referred to as electrode) and the conducting paths 9*a* nearest to each of the electrodes shown in FIG. 17, when at least the distance $L_2$ between the electrode at the electric power-supply side and the conducting path nearest thereto is at least 20% based on the distance $L_3$ between the opposite electrodes, the deterioration of insulating performance due to the use of the conducting path 9*a* can be substantially prevented. This fact will be explained referring to FIG. 18.

Figure 18:
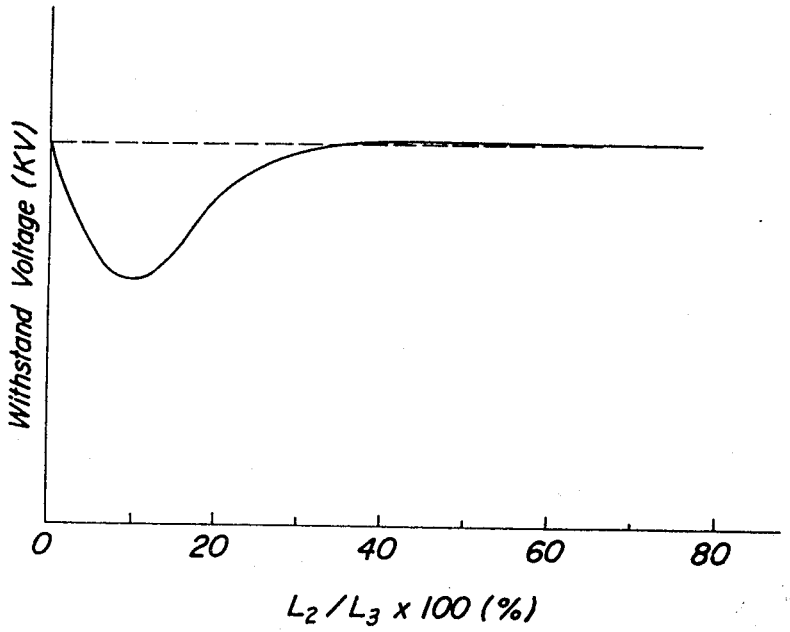
FIG. 18 is a graph illustrating a relation between the ratio of $L_2/L_3$ and the withstand voltage in the synthetic resin insulator shown in FIG. 17.

FIG. 18 illustrates the withstand voltage property of the insulator with and not with the conducting path 9*a*. FIG. 17 illustrates the sample insulators being made on experiment. These sample insulators having the distance of 6,000 mm between the opposite electrodes are arranged with conducting paths 9*a* at intervals of about 300 mm. In FIG. 18, the solid line illustrates the result in the case where conducting paths 9*a* are arranged at intervals of about 300 mm and the conducting path 9*a* nearest to the electrode at the energized end side is adjusted to vary the distance $L_2$ between the electrode at the energized end side and the conducting path 9*a* nearest to the electrode.

It can be seen from FIG. 18 that, when the ratio in percentage of $L_2/L_3$ is at least 20%, wherein $L_2$ is the distance between the electrode at the energized end side and the conducting path 9*a* adjacent thereto and $L_3$ is the distance between the opposite electrodes, the withstand voltage of the insulator does not substantially decrease.

The synthetic resin insulator of the present invention, for example, one having a structure to be filled with grease or an adhesive, can be assembled by the following method. A reinforced plastic rod 1, a necessary number of overcoats 3, having been individually produced and having a given length are provided, and a number of conducting paths 9*a* having a hollow cylindrical shape or the like having an inner diameter larger than the outer diameter of the end portion of the overcoat 3 are required the same as the number of joint portions 5. One end of each overcoat 3 is fitted into a conducting path 9*a*, and then the overcoat 3 having a conducting path 9*a* are fitted to the reinforced plastic rod 1 together with grease or an adhesive. In this case, it is preferable that the inner diameter of each overcoat 3 is not excessively larger than the outer diameter of the reinforced plastic rod in order not to expand the surface of the overcoat towards the peripheral direction at the fitted state. Then, the conducting path 9*a* is uniformly compressed in the centripetal direction at a given position by means of a hydraulic press arranged radially and is deformed and reduced so that the conducting path 9*a* is tightly fixed to the end portion of the overcoat 3 to press it.

Figure 1:
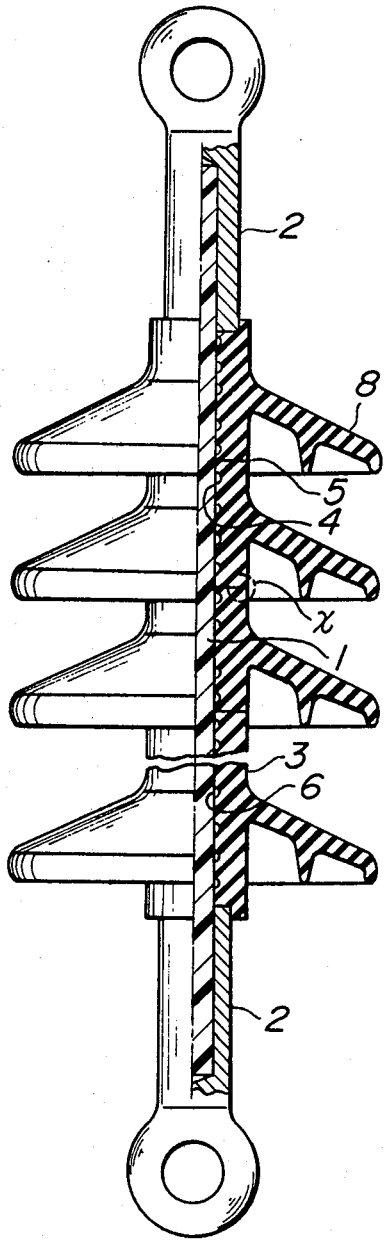
FIG. 1 PRIOR ART
FIG. 1 is a front view of a conventional synthetic resin insulator, partly in section, hereinbefore explained.
Figure 2A:
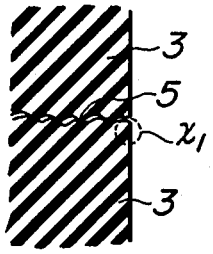
FIG. 2a PRIOR ART
FIGS. 2*a* and 2*b* are views hereinbefore used for explaining the erosion of contact portion of adjacent overcoats.
Figure 2B:
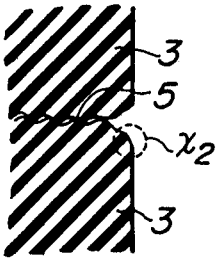
FIG. 2b PRIOR ART
Figure 3A:
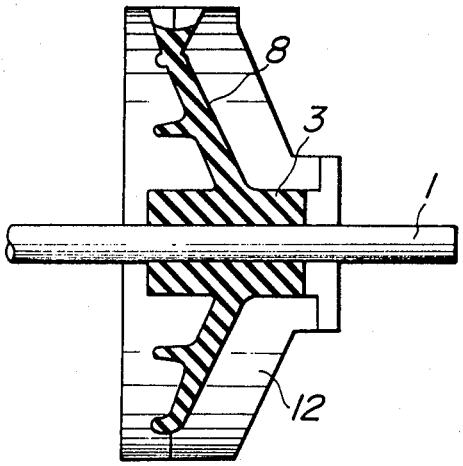
FIG. 3a PRIOR ART
FIGS. 3*a* and 3*b* are views hereinbefore used for explaining the formation of overcoats having a unitary structure by repeated moldings.
Figure 3B:
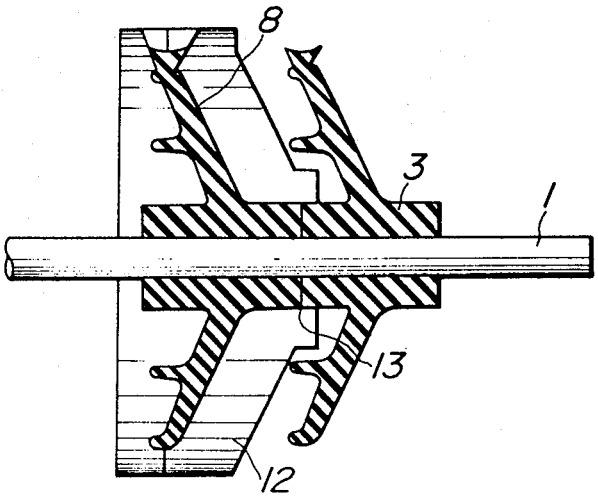
FIG. 3b PRIOR ART

After the overcoats 3 are fitted to the reinforced plastic rod 1 together with grease 6 or an adhesive and then the conducting paths 9*a* are fitted to the joint portions 5, holding metal fittings are fixed to both ends of the reinforced plastic rod 1 to assemble a synthetic resin insulator of the present invention. When a frame capable of molding an individual overcoat 3 having one shed is used to mold directly the overcoat 3 on a reinforced plastic rod 1 as illustrated in FIGS. 3*a* and 3*b* and this molding is repeatedly carried out to produce an insulator having substantially a unitary structure, a conducting path 9*a* is fitted to the overcoat in every molding similarly to the production of an insulator having the above-described structure containing grease filled therein, and after the total moldings are completed, the conducting path 9*a* is compressed in the centripetal direction on a given position, that is, on an adhering plane 13 of adjacent overcoats 3, whereby the conducting path 9*a* is deformed and reduced so that the conducting path 9*a* is tightly contacted to the surface of the overcoat 3. Then, holding metal fittings are fixed to both ends of the reinforced plastic rod 1 to assemble a synthetic resin insulator of the present invention.

Figure 19:
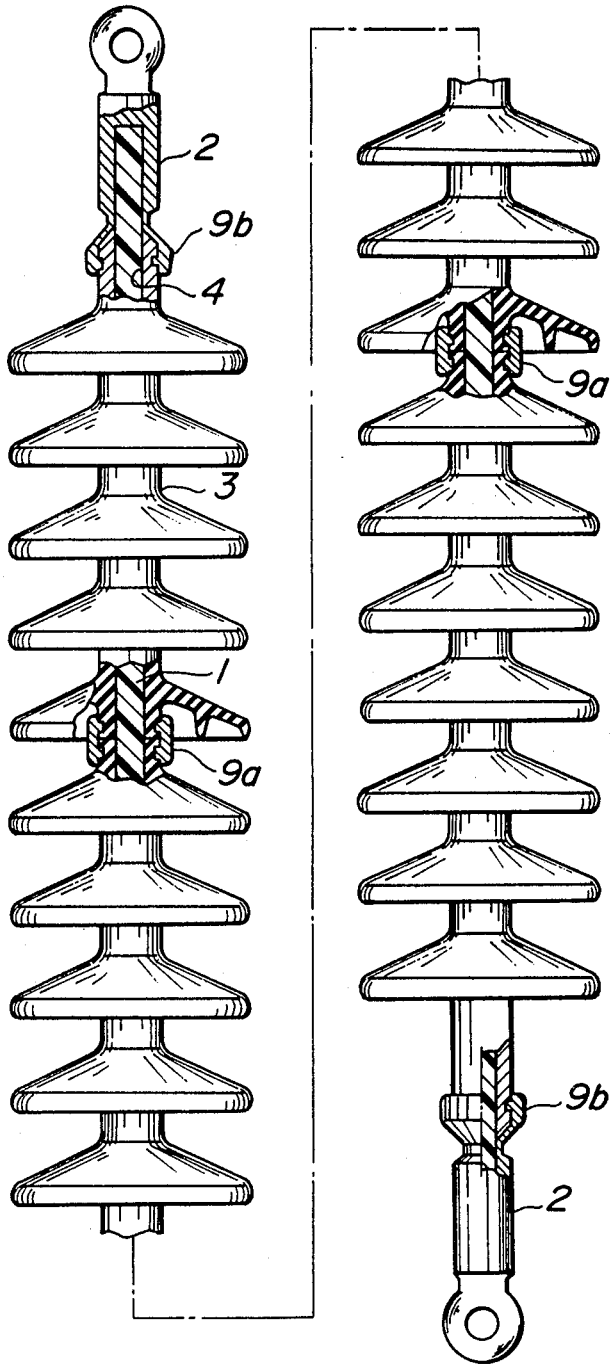
FIG. 19 is a front view of another embodiment of a synthetic resin insulator of the present invention, partly in section.

The present invention can be variously modified from the above-described embodiments without departing from the scope of the present invention. For example, in the above-described example, the end portion of a holding metal fitting 2 is surrounded with an overcoat 3. Further, in the present invention, an insulator having the following structure is preferably used due to the reason that minute discharges at the joint portion 5 of adjacent overcoats 3 can be prevented, the end portions of adjacent overcoats can be mutually and firmly fixed and an overcoat 3 can be airtightly isolated from the external atmosphere at the interface 4 between the reinforced plastic rod 1 and the overcoat 3 to prevent surely the penetration of water and the like into the interface 4. That is, in this structure, a sleeve 9*b* which receives the end portion of an overcoat 3 and is contacted thereto, is airtightly fixed to a holding metal fitting 2 at the side for receiving a reinforced plastic rod by a threaded engagement or unitary working through a seal tape or O-ring as illustrated in FIG. 19, and further a conducting path 9*a* straddling a joint portion 5 of overcoats 3 is formed by bending a metal plate into a cylindrical shape closely adhering to the surface of the insulator along the peripheral direction as illustrated in FIG. 7, whereby the end portion of the overcoat 3 is received in the conducting path, and the conducting path is compressed uniformly in the centripetal direction and is deformed and reduced to press the end portion of the overcoat 3. When the outer diameter of an overcoat 3 or the inner diameters of a conducting path 9*a* and sleeve 9*b* are adjusted so that the conducting path 9*a* and sleeve 9*b* are contacted with the surface of an overcoat 3 at the inlet portion and are pressed against the overcoat 3 at the inner portion, the elongation of the surface of the overcoat 3 is small in the portion exposed to the external atmosphere and the growth of groove-shaped erosion can be prevented.

It is preferable that synthetic resin insulators having overcoats made of an elastic insulating material, such as ethylene-propylene rubber or the like, are free from damage at the fitting to steel tower or the like, and are excellent in the handling. On the contrary, overcoats made of these rubbers are poor in the erosion resistance due to the structure at the joint portion of the overcoats. According to the present invention, the joint portion can be protected, and synthetic resin insulators having the above-described excellent properties can be obtained.

Thermoplastic resins, such as polyethylene and the like, do not contain —C=C— bonds in the chemical structure and are excellent in the tracking resistance. However, in the production of overcoats, it is preferable that individual overcoats, each having one shed, are individually produced, and then superposed to form the overcoats in view of the moldability of the thermoplastic resin. Accordingly, the drawbacks at the contact portion of overcoats of synthetic resin insulators having such overcoats can be overcome by the present invention. Further, when it is intended to produce an insulator by a method, wherein an individual overcoat having one shed is directly molded on a reinforced plastic rod, and this molding is repeatedly carried out to form overcoats having substantially a unitary structure, thermosetting resins, such as cycloaliphatic epoxy and the like, are used due to their good moldability. The present invention can overcome the drawbacks of an interface of adjacent overcoats adhered with each other through the above-described methods.

As described above, according to the present invention, synthetic resin insulators having excellent erosion resistance can be produced without losing excellent properties inherent to each elastic insulating material.

According to the present invention, conducting paths are arranged to synthetic resin insulators, whereby leakage current which is a cause of minute discharges is locally short-circuited and does not flow in the joint portion of overcoats, which contact portion is apt to be most easily eroded by the deterioration due to ultraviolet ray and oxygen in air and by the minute discharges generated on the overcoat surface during the rainfall, and the joint portion of overcoats are protected from erosion due to the minute discharges. Particularly, the conducting path, which is produced by curving a metal plate having a given width along the peripheral direction of the surface of an insulator, can interrupt ultraviolet ray and the like, and protects the joint portion of overcoats from the deterioration due to ultraviolet ray.

Moreover, in the insulator, wherein the joint portion of overcoats is airtightly and firmly fixed by a hollow cylindrical conducting path and further the end portion of the uppermost and lowermost overcoats is airtightly and firmly fixed, penetration of water into the interface between the reinforced plastic rod and the overcoat or leakage of grease from the interface can be prevented at the same time.

Further, in the insulator of the present invention, the overhung length of a shed of an overcoat adjacent to a conducting path, the distance between the sheds of adjacent overcoats, or the length of overcoats having a unitary structure at the energized end side or at the earth side are properly selected, whereby the deterioration of insulating performance of the insulator can be prevented.

As described above, according to the present invention, there can be prevented the deterioration of insulating performance which occurs in a very short period of time in the conventional insulators due to deterioration by oxidation generated from the seam of overcoats, erosion caused by minute discharges, penetration of water into the interface of the reinforced plastic rod and the overcoat through the seam of overcoats and leakage of grease from the seam. Further, even when a large number of short insulators having one-piece overcoats are connected to each other and used, there can be decreased the deterioration of reliability, the loss of insulating distance and the increase of weight due to the series connection of a large number of holding metal portions, wherein the concentration of mechanical stress and electric stress are developed, and long synthetic resin insulators having excellent insulating property and erosion resistance, which are light in weight and are high in strength and in reliability, can be obtained. Particularly, the synthetic resin insulators of the present invention can be widely used as an insulator for ultra-high voltage transmission line and the like, and the present invention is very contributive for the development of industry.

What is claimed is:

1. A synthetic resin insulator, comprising a fiber-reinforced plastic rod, holding metal fittings which hold both ends of the fiber-reinforced plastic rod, a plural number of overcoats which consist of an elastic insulating material and cover the total surface of the fiber-reinforced plastic rod located between the holding metal fittings, and conducting paths formed straddling the joint portion of adjacent overcoats in order that leakage current, which flows on the surface of the insulator when the insulator is wetted, flows through the conducting path and does not flow through the joint portion of the overcoats.

2. A synthetic resin insulator according to claim 1, wherein each overcoat has a shed or a plural number of sheds unitarily formed at its outside.

3. A synthetic resin insulator according to claim 2, wherein the conducting path straddling the joint portion of adjacent overcoats is formed by curving a strip-shaped conducting member along the surface of the insulator in the peripheral direction.

4. A synthetic resin insulator according to claim 2, wherein the conducting path straddling the joint portion of adjacent overcoats has a hollow cylindrical shape.

5. A synthetic resin insulator according to claim 2, wherein the conducting path straddling the joint portion of adjacent overcoats consists of two conducting rings connected to each other through a conducting member.

6. A synthetic resin insulator according to claim 1, wherein the ends of overcoats opposite to each other are apart from each other at the joint portion of adjacent overcoats.

7. A synthetic resin insulator according to claim 6, wherein the conducting path straddling the joint portion of adjacent overcoats is formed by curving a strip-shaped conducting member along the surface of the insulator in the peripheral direction.

8. A synthetic resin insulator according to claim 6, wherein the conductive path straddling the joint portion of adjacent overcoats has a hollow cylindrical shape.

9. A synthetic resin insulator according to claim 6, wherein the conducting path straddling the joint portion of adjacent overcoats consists of two conducting rings connected to each other through a conducting member.

10. A synthetic resin insulator according to claim 1, wherein the conducting path straddling the joint portion of adjacent overcoats is formed by curving a strip-shaped conducting member along the surface of the insulator in the peripheral direction.

11. A synthetic resin insulator according to claim 1, wherein the conducting path straddling the joint portion of adjacent overcoats has a hollow cylindrical shape.

12. A synthetic resin insulator according to claim 1, wherein the conducting path straddling the joint portion of adjacent overcoats consists of two conducting rings connected to each other through a conducting member.

13. A synthetic resin insulator according to any one of claims 1–12, wherein the length $l_1$ of the conducting path in the axial direction, the overhung length H of a shed adjacent to the conducting path, and the distance $l_2$ between adjacent sheds satisfy the relations $$H \geqq \tfrac{1}{2} l_1 \text{ and } 2H \geqq l_2.$$

14. A synthetic resin insulator according to any one of claims 1–12, wherein the distance $L_2$ between the holding metal fitting at the energized end side and the conducting path nearest to the holding metal fitting is at least 20% based on the effective length $L_3$ of the insulator.

15. A synthetic resin insulator according to claim 1, 2 or 6, wherein the elastic insulating material is a tracking-resistant rubber, such as ethylene-propylene rubber.

16. A synthetic resin insulator according to claim 1, 2 or 6, wherein the elastic insulating material is a tracking-resistant thermoplastic resin, such as polyethylene, which does not contain —C=C— bond in the chemical structure.

17. A synthetic resin insulator according to claim 1, 2 or 6, wherein the elastic insulating material is a tracking-resistant thermosetting resin, such as cycloaliphatic epoxy.

* * * * *